US006000871A

United States Patent [19]

Fisher, Sr.

[11] Patent Number: 6,000,871

[45] Date of Patent: Dec. 14, 1999

[54] PRINTER AND RECEIVER SUPPLY TRAY ADAPTED TO SENSE AMOUNT OF RECEIVER THEREIN AND METHOD THEREOF

[75] Inventor: Terrence L. Fisher, Sr., Rochester, N.Y.

[73] Assignee: Eastman Kodak Company, Rochester, N.Y.

[21] Appl. No.: 09/054,960

[22] Filed: Apr. 3, 1998

[51] Int. Cl.[6] ..... B41J 29/18

[52] U.S. Cl. ..... 400/706; 400/707.2; 400/703; 271/255.01

[58] Field of Search ..... 271/110, 258.01, 271/258.02, 258.03, 258.04, 258.05, 259; 400/703, 710, 708, 706, 706.1, 711, 707.2; 101/232; 73/296; 250/905

[56] References Cited

U.S. PATENT DOCUMENTS

| | | | |
|---|---|---|---|
| 4,928,949 | 5/1990 | Ramsey et al. | 271/111 |
| 4,936,681 | 6/1990 | Ruhrmann | 356/133 |
| 5,078,379 | 1/1992 | Leisner | 271/3.1 |
| 5,096,180 | 3/1992 | Nagaoka et al. | 271/110 |
| 5,102,112 | 4/1992 | Takahashi | 271/9 |
| 5,311,272 | 5/1994 | Daniels et al. | 356/5 |
| 5,347,350 | 9/1994 | Nakahata et al. | 355/309 |
| 5,572,630 | 11/1996 | Azuma et al. | 395/111 |
| 5,629,672 | 5/1997 | Brown et al. | 340/540 |

*Primary Examiner*—Edgar Burr
*Assistant Examiner*—Dave A. Ghatt
*Attorney, Agent, or Firm*—Walter S. Stevens

[57] ABSTRACT

A printer and receiver supply tray adapted to sense amount of receiver therein, and method thereof. The printer comprises a print head for printing an image on the receiver and a supply tray associated with the print head for holding a plurality of cut sheets of the receiver, the cut sheets defining a stack of sheets having a predetermined height. A sheet feeder engages the stack of sheets for sequentially feeding sheets from the tray and to the print head, such that height of the stack of sheets decreases as the sheets are fed therefrom. A platen is movably connected to the tray for continuously supporting the stack of sheets in the tray as height of the stack of sheets decreases. An indicator is connected to the platen and movable therewith for indicating height of the stack of sheets as the height of the stack of sheets decreases. The indicator has a surface area thereon of a predetermined light reflectance associated with the amount of sheets in the tray. A sensor is optically coupled to the indicator for sensing light reflected from the surface area thereof, the sensor being adapted to cast light on the surface area and sense the light reflected therefrom.

20 Claims, 8 Drawing Sheets

PRINTER AND RECEIVER SUPPLY TRAY ADAPTED TO SENSE AMOUNT OF RECEIVER THEREIN AND METHOD THEREOF

BACKGROUND OF THE INVENTION

The present invention generally relates to printer apparatus and methods and more particularly relates to a printer and receiver supply tray adapted to sense amount of receiver therein, and method thereof.

Thermal printers form a color print by successively printing with a dye donor onto individual sheets of a dye receiver (i.e., paper or transparency). The print head of such a thermal printer commonly provides a print line of thermal resistive elements that can be individually heated in order to transfer dye from the donor to the receiver. Such print heads can take any of several forms including resistive element, resistive ribbon and laser print heads.

More specifically, a typical color thermal printer includes the previously mentioned print head and a platen. A picker mechanism "picks" individual sheets of the receiver from a stack of cut sheets of the receiver and feeds the individual sheets into a nip area defined between the print head and platen. The donor is positioned between the print head and platen. The print head is then lowered, so that the donor and receiver sheet are sandwiched between the print head and platen. An image is printed on the sheet by selectively heating the elements of the print head in order to transfer a first dye to the receiver sheet. The receiver sheet is then repositioned to receive a second color of the image, and the donor is positioned to provide a second dye color. These steps are repeated until all colors of the image are printed and the completed print is ejected from the printer.

Moreover, a receiver cassette tray loaded with the stack of cut receiver sheets is removably inserted into the printer. However, the height of the tray is usually limited in order to reduce the overall height of the printer, so that the printer may fit within confined spaces, such as are found in shelving and equipment racks. However, limiting height of the tray also limits number of receiver sheets that can be stored in the tray. This limitation in number of receiver sheets in turn causes the printer to run-out of sheets relatively quickly, thereby necessitating frequent replenishment of receiver sheets. However, it is inconvenient for the printer to run-out of receiver sheets during a production run, which may occur if the tray is low in receiver sheets at the start of the production run. It is therefore desirable to avoid starting a production run when the number of sheets in the tray is low. Therefore, the prior art printers mentioned hereinabove suffer from a problem of running-out of receiver sheets during a production run due to low receiver sheets being present in the tray at the start of the production run.

In addition, the receiver tray may include a cardboard plaque at the bottom of the stack of receiver sheets for supporting the stack of receiver sheets. When the stack of receiver sheets is depleted, the previously mentioned picker attempts to "pick" the cardboard plaque; however, the picker cannot pick the cardboard plaque due to the weight and stiffness of the cardboard plaque. When this occurs, some printers generate an error code shown on a display attached to the printer, which error code erroneously informs an operator of the printer that the printer has malfunctioned and is unable to pick receiver sheets. It is desirable to avoid display of the error code, which occurs when the picker attempts to pick the cardboard plaque. Therefore, another problem in the art is generation of an error code due to the picker attempting to pick the cardboard plaque at the bottom of a stack of receiver sheets.

Printers having low paper detection systems are known. An image production device having a paper supply "low" detection system is disclosed in U.S. Pat. No. 5,629,672 titled "Low Paper Detection System" issued May 13, 1997 in the name of Stephen S. Brown, et al. This patent discloses a paper image reproduction device having a cabinet which in turn has at least one paper cassette therein bearing a supply of stacked paper sheets. A detector is disposed in the cabinet for sensing a partial supply of paper in the paper cassette. However, the Brown et al. disclosure requires use of a cabinet in addition to the paper cassette. This cabinet is an additional bulky component that must be inserted into the printer. This is undesirable because use of an additional bulky component increases cost of the printer and may decrease printer reliability. Also, use of such an additional major component necessarily increases the "footprint" or even height of the printer. Therefore, yet another problem in the art is addition of a bulky component to detect a paper supply "low" condition, which additional bulky component necessarily increases "footprint" and height of the printer.

Therefore, there has been a long-felt need to provide a suitable printer and receiver supply tray adapted to sense amount of receiver therein, and method thereof.

SUMMARY OF THE INVENTION

An object of the present invention is to provide a suitable printer adapted to sense amount of receiver therein, and method thereof.

With this object in view, the invention resides in a printer adapted to sense amount of receiver therein, comprising a print head, a tray associated with said print head for holding a plurality of cut sheets of the receiver, and an indicator connected to said tray and responsive to amount of sheets in said tray, said indicator having a surface area thereon of a predetermined light reflectance associated with the amount of sheets in said tray.

In one embodiment of the present invention, a printer includes a receiver supply tray adapted to sense amount of receiver therein. Moreover, the printer comprises a print head for printing an image on the receiver and a supply tray associated with the print head for holding a plurality of cut sheets of the receiver, the cut sheets defining a stack of sheets having a predetermined height. A sheet feeder is associated with the tray and engageable with the stack of sheets for sequentially feeding the sheets from the tray and to the print head, so that height of the stack of sheets decreases as the sheets are fed therefrom. A platen is movably connected to the tray for continuously supporting the stack of sheets in the tray as height of the stack of sheets decreases. In addition, an indicator is connected to the platen and movable therewith for indicating height of the stack of sheets as the height of the stack of sheets decreases. In this manner, the indicator moves in response to amount of sheets in the tray. The indicator has a first surface area thereon of a predetermined first light reflectance associated with a "low amount" (i.e., low number) of sheets in the tray. Moreover, a sensor is optically coupled to the indicator for sensing light reflected from the first surface area thereof, the sensor being adapted to cast light on the first surface area and sense the light reflected therefrom as the first surface area moves into alignment with the sensor, which occurs when the platen moves to a position corresponding to the "low amount" of sheets in the tray. The indicator also may have a second surface area thereon of a predetermined second light reflectance less than the first light reflectance. If desired, the "predetermined second light reflectance" may be "black" such that no light is reflected. The second light reflectance is associated with a "no amount" of sheets in the tray. Moreover, the sensor also senses light reflected from the second surface area by first casting light on the second surface area and then sensing the light reflected therefrom as the second surface area moves into alignment with the sensor, which occurs when the platen moves to a position corresponding to the "no amount" of sheets in the tray. A controller interconnecting the sheet feeder and the sensor also may be provided for interrupting operation of the sheet feeder as the sensor senses no height (i.e., "no amount") of sheets in the tray. Also, a display is associated with the sensor for displaying height of sheets in the tray.

A feature of the present invention is the provision of a light-reflective indicator responsive to height of a stack of sheets in the tray for indicating height of the stack of sheets as the height of the stack of sheets decreases.

Another feature of the present invention is the provision of a sensor optically coupled to the indicator for sensing light reflected from a surface area thereof.

An advantage of the present invention is that use thereof reduces risk of running-out of receiver sheets during a production run due to low receiver sheets being present in the tray at the start of the production run.

Another advantage of the present invention is that use thereof reduces likelihood of generation of an error code due to the picker attempting to pick a cardboard plaque at the bottom of the stack of receiver sheets.

Yet another advantage of the present invention is that addition of a bulky component to detect receiver stack height is avoided, which additional bulky component would otherwise increase footprint and/or height of the printer.

These and other objects, features and advantages of the present invention will become apparent to those skilled in the art upon a reading of the following detailed description when taken in conjunction with the drawings wherein there is shown and described illustrative embodiments of the invention.

BRIEF DESCRIPTION OF THE DRAWINGS

While the specification concludes with claims particularly pointing-out and distinctly claiming the subject matter of the present invention, it is believed the invention will be better understood from the following description when taken in conjunction with the accompanying drawings wherein:

DESCRIPTION OF PREFERRED EMBODIMENTS OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
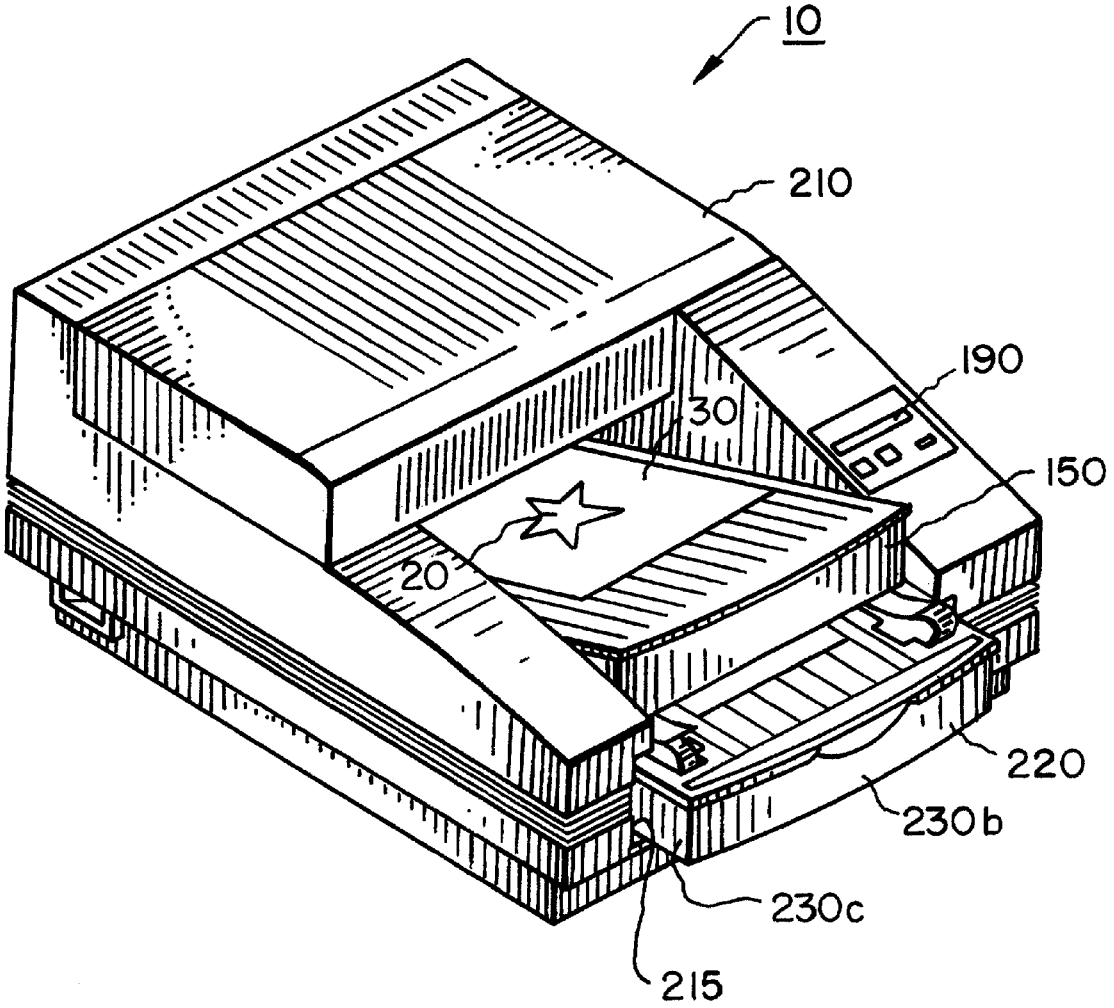
FIG. 1 is a view in perspective of a printer belonging to the present invention, the printer having a receiver supply tray disposed thereinto.
Figure 2:
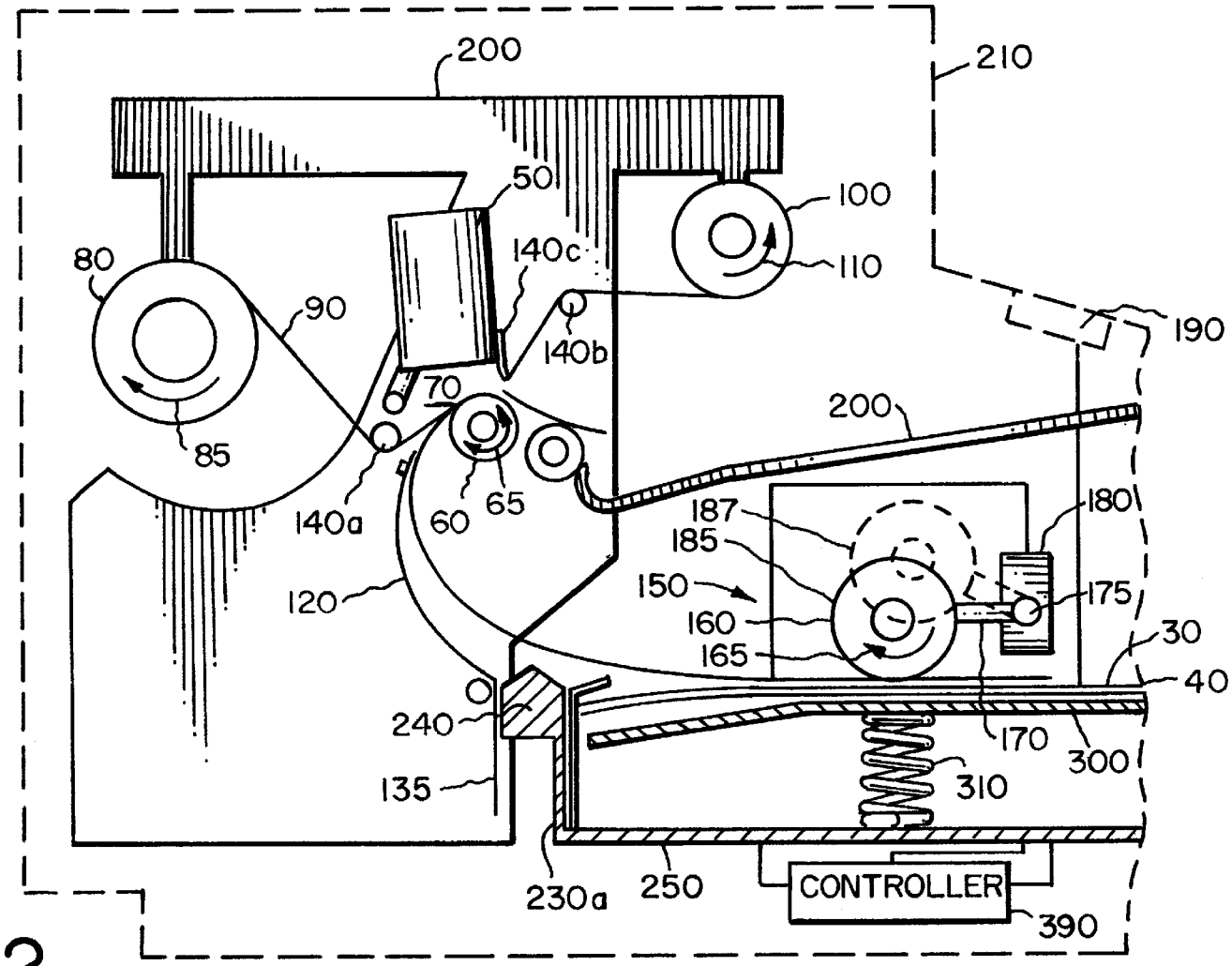
FIG. 2 is a view in vertical section of the printer with parts removed for clarity.
Figure 3:
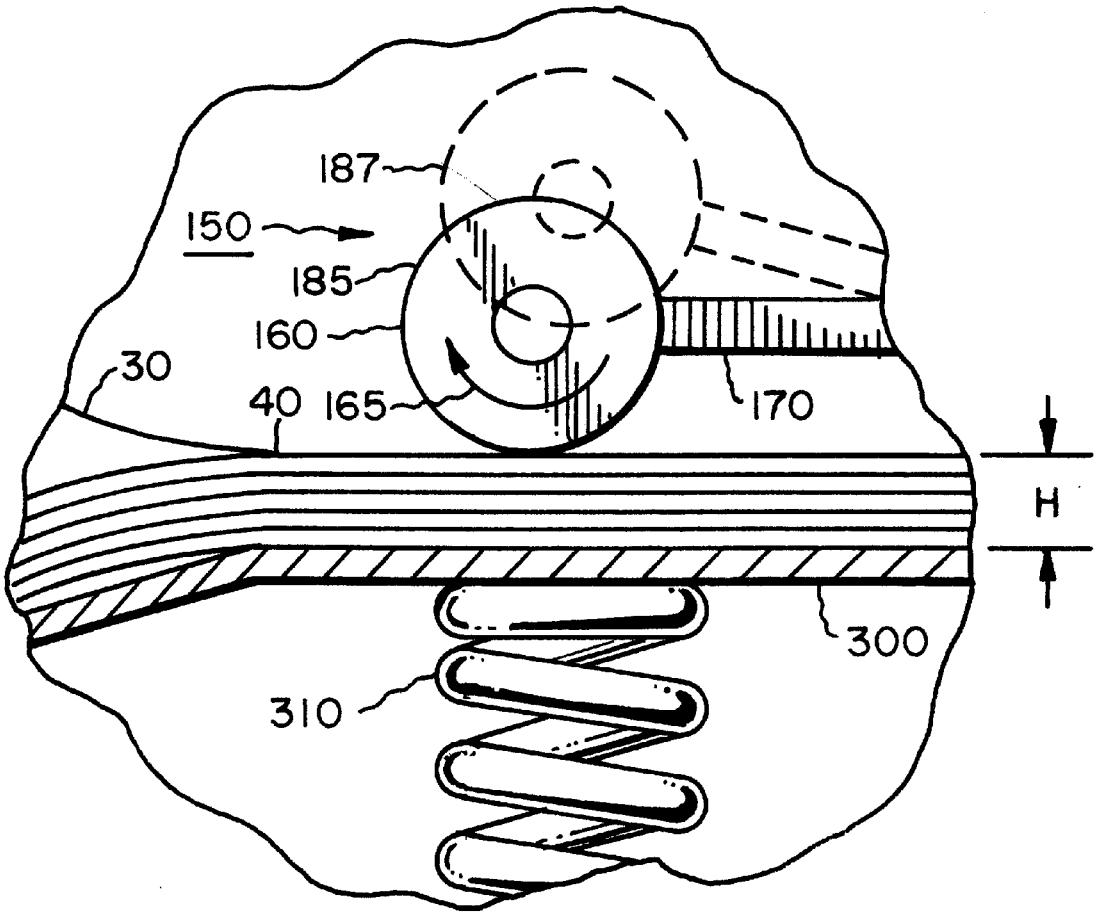
FIG. 3 is a fragmentation view in vertical section of a portion of a platen belonging to the supply tray, the platen having a stack of cut sheets of receiver disposed thereon and being supplied therefrom by means of a picker roller engaging the stack of receiver sheets.
Figure 4:
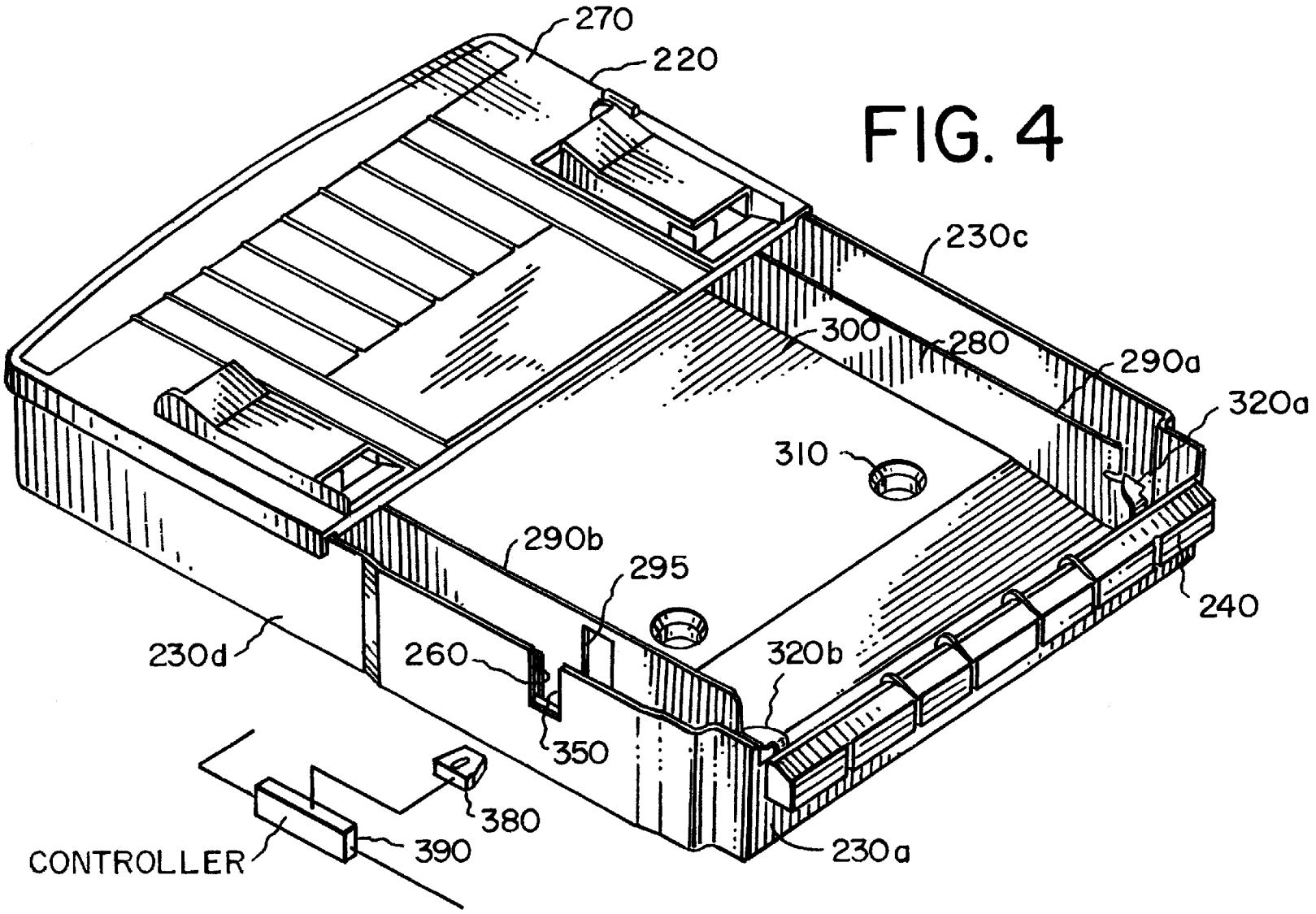
FIG. 4 is a view in perspective of the tray showing a slot formed in a sidewall thereof.
Figure 5:
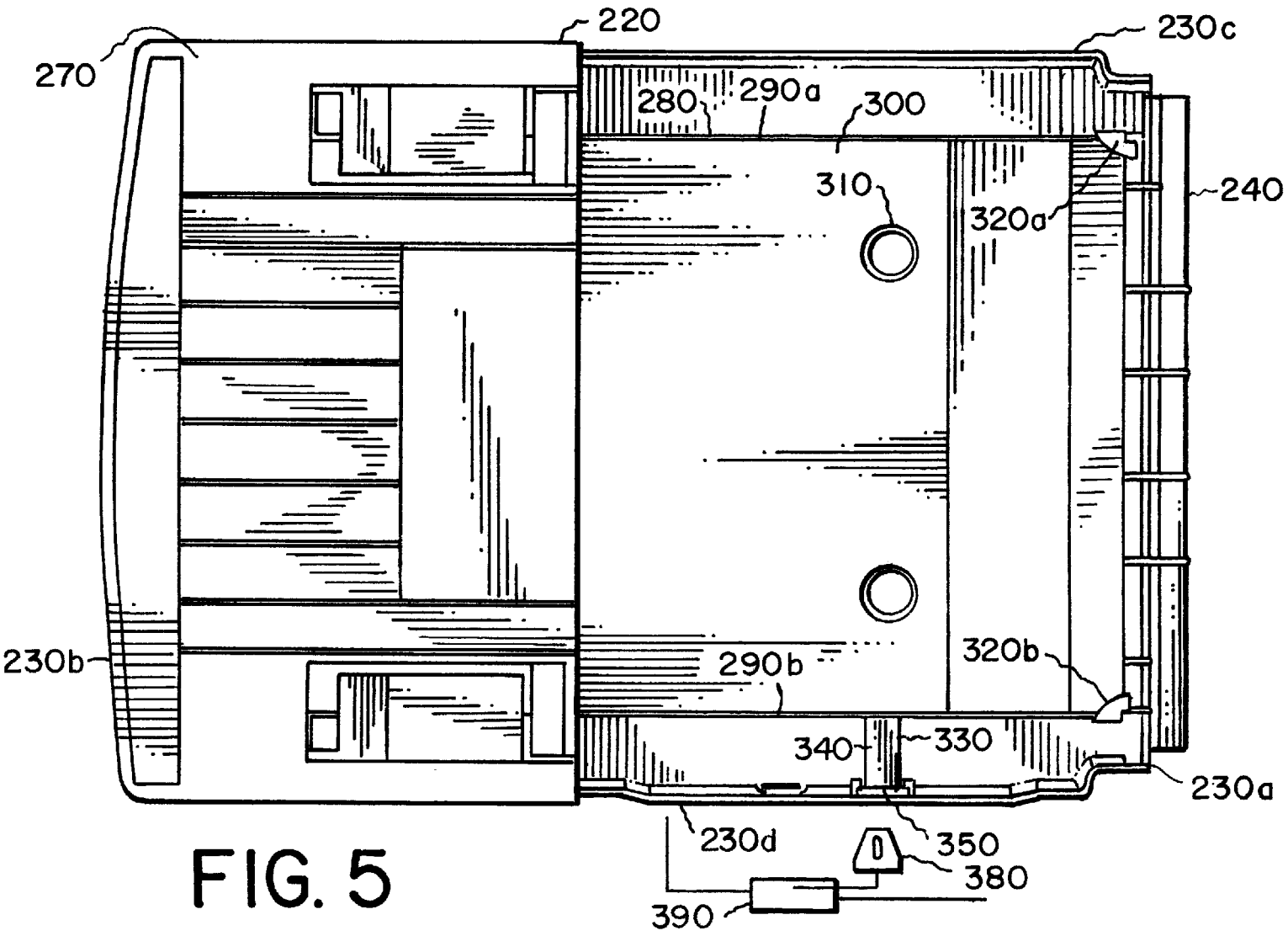
FIG. 5 is a plan view of the tray, this view showing an indicator integrally connected to the platen, the indicator having an indicator arm.
Figure 6:
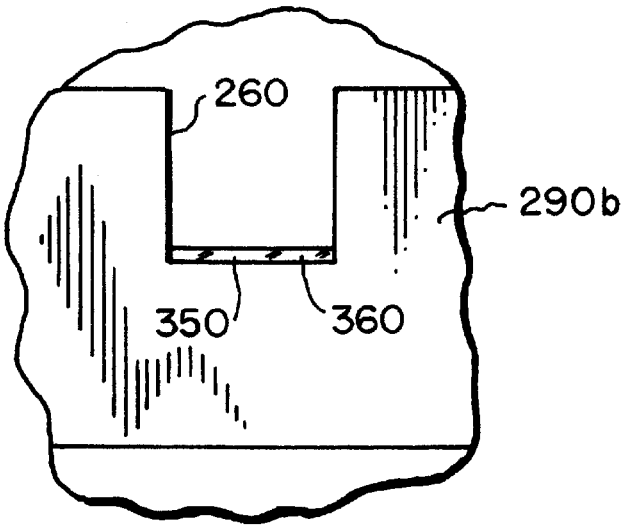
FIG. 6 is a fragmentation view of the sidewall having the slot formed therein and a flange portion belonging to the indicator arm, the flange portion being slidable in the slot.
Figure 9:
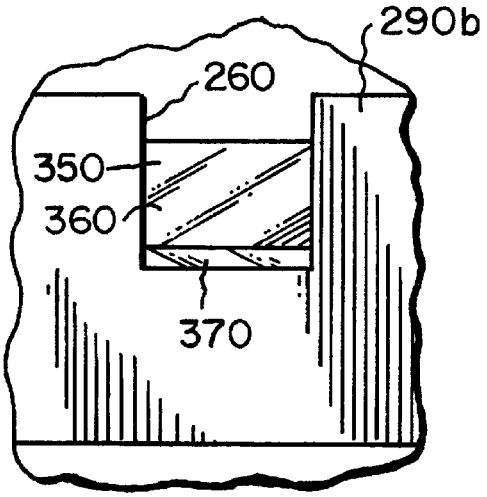
FIG. 9 is a fragmentation view of the sidewall having the slot formed therein and the flange portion belonging to the indicator arm, the flange portion having the first and second reflective surface areas thereon, the first surface area being at a height alignable with the sensor, so that the sensor senses a "low receiver sheet" condition.
Figure 10:
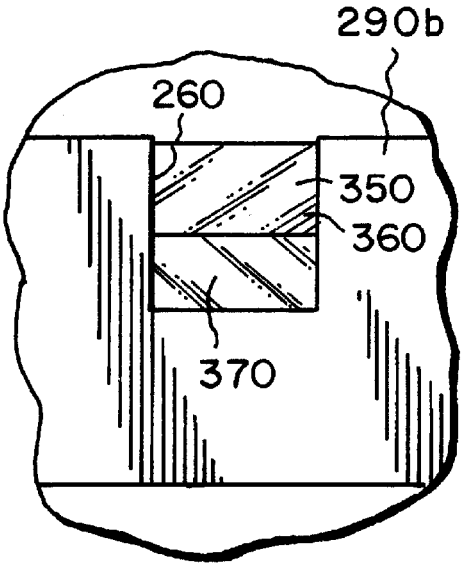
FIG. 10 is fragmentation view of the sidewall having the slot formed therein and the flange portion belonging to the indicator arm, the flange portion having the first and second reflective surface areas thereon, the second surface area being at a height alignable with the sensor, so that the sensor senses a "no receiver sheet" condition.
Figure 7:
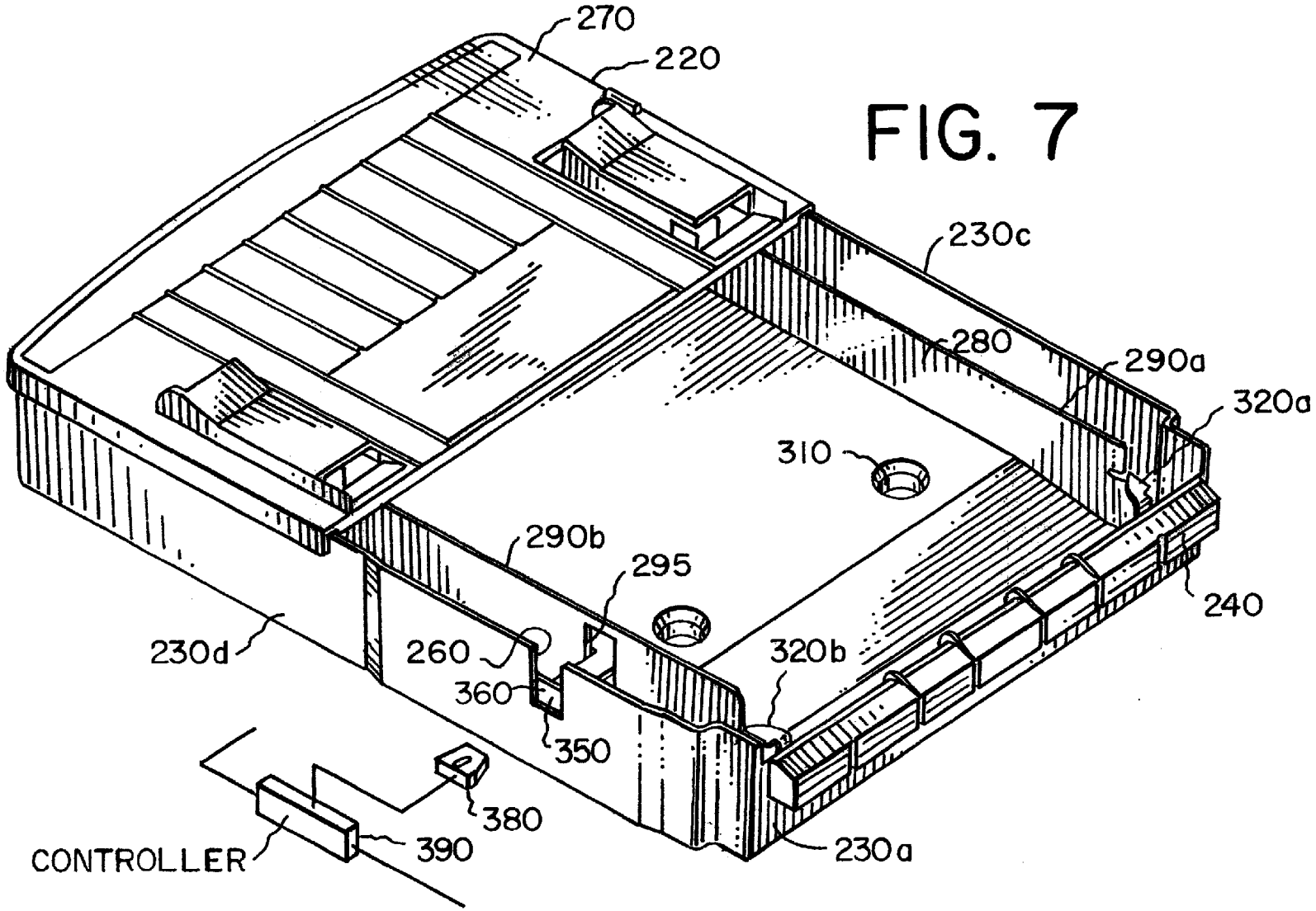
FIG. 7 is another perspective view of the tray, this view showing the sidewall and slot and also showing a first reflective surface area on the flange portion, which first surface area is detectable by a light-sensitive sensor to indicate a "low receiver sheet" condition.
Figure 8:
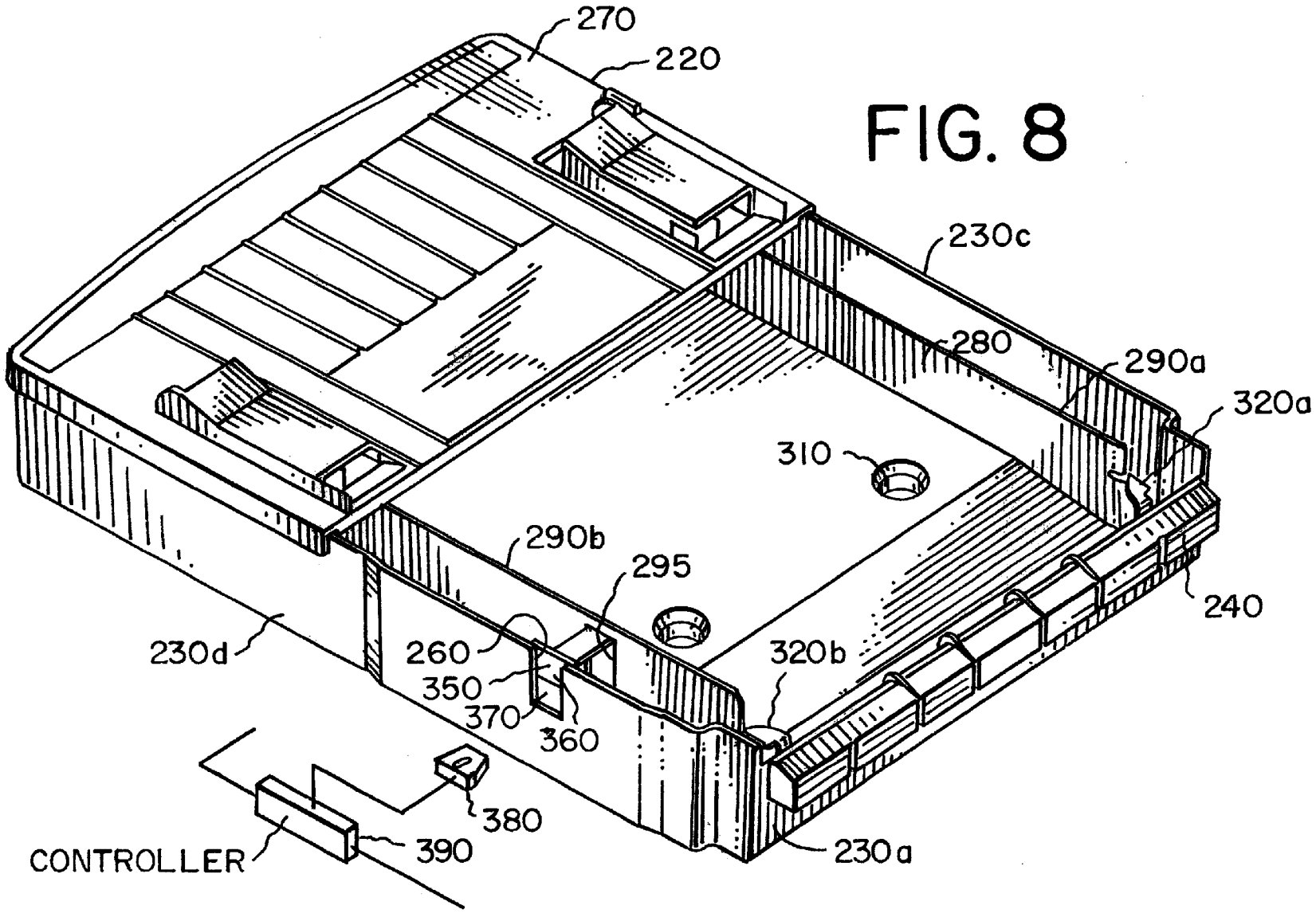
FIG. 8 is yet another perspective view of the tray, this view showing the sidewall and slot and also showing a second reflective surface area on the flange portion, which second surface area is detectable by the light-sensitive sensor to indicate a "no receiver sheet" condition.

Therefore, referring to FIGS. 1, 2 and 3, there is shown a thermal resistive printer, generally referred to as 10, for forming an image 20 on a receiver sheet 30 which may be paper or transparency. A plurality of the receiver sheets 20 define a stack 40 of receiver sheets having a height "H". Printer 10 comprises a thermal resistive print head 50 formed of a plurality of resistive heating elements (not shown), for reasons disclosed hereinbelow. Disposed opposite print head 50 is a support 60 for supporting and transporting receiver sheet 30 through printer 10, which support 60 is adapted to rotate bi-directionally as shown by a double-headed first arrow 65. In this regard, support 60 may be connected to a reversible motor (not shown) for rotating support 60 bi-directionally. Print head 50 and support 60 define a collapsible nip 70 therebetween for passage of receiver sheet 30 therethrough. In this regard, nip 70 is capable of being opened and closed when print head 50 is upwardly and downwardly moved, respectively, with respect to support 60. Receiver sheet 30 is reversibly transported through nip 70 by means of engagement with rotatable support 60. As receiver sheet 30 is transported through nip 70, the nip 70 is closed and the previously mentioned heating elements are activated to cause printing of image 20 onto receiver sheet 30, as described more fully hereinbelow.

Referring again to FIGS. 1, 2 and 3, printer 10 further comprises a dye donor supply spool 80 adapted to freely rotate in a direction of a second arrow 85. Wound about donor supply spool 80 is a movable dye donor ribbon 90 containing a plurality of dye-containing color patches (not shown). Disposed relative to donor supply spool 80 is a dye donor take-up spool 100 adapted to rotate in a direction of a third arrow 110. In this regard, take-up spool 100 is connected to a motor (not shown) for rotating take-up spool 100 in the direction of third arrow 110. Donor supply spool 80 supplies dye donor ribbon 90 from donor supply spool 80 to take-up spool 100 as take-up spool 100 rotates. It may be understood that as donor supply spool 80 supplies dye donor ribbon 90 therefrom to take-up spool 100, ribbon 90 will be suspended between spools 80 and 100 and pass through nip 70 between receiver sheet 30 and print head 50. It may be further understood that as nip 70 closes, the previously mentioned heating elements in print head 50 are enabled such that radiative heat therefrom causes dye to transfer from ribbon 90 to receiver sheet 30 in order to form the image 20 on receiver sheet 30. That is, as ribbon 90 is sandwiched between print head 50 and receiver sheet 30, image 20 is printed by selectively heating individual ones of the heating elements in print head 50 in order to transfer a first dye to receiver sheet 30. Receiver sheet 30 is then repositioned by means of rotating support 60 to receive a second color of the image, and ribbon 90 is positioned by means of take-up spool 100 to provide a second dye color. These steps are repeated until all colors of image 20 are printed and the completed print is ejected from printer 10.

Referring yet again to FIGS. 1, 2 and 3, movement of ribbon 90 through nip 70 and enablement of the heating elements in print head 50 are preferably synchronized to transfer the dyes from ribbon 90 to receiver sheet 30 at the desired times and predetermined locations on receiver sheet 30. Therefore, a control unit (not shown) is connected to print head 50 for controlling print head 50, so that the heating elements are enabled when desired. Also, the control unit may be connected to print head 50 for upwardly and downwardly moving print head 30 in order to open and close nip 70 when required. The control unit may also be connected to take-up spool 100 for controlling take-up spool 100, so that operation of take-up spool 100 is synchronized with operation of print head 50.

Still referring to FIGS. 1, 2 and 3, printer 10 also comprises a guide ramp 120 and a freely rotatable guide roller 130 aligned with nip 70 for guiding receiver sheet 30 into and through nip 70, respectively. Guide ramp 120 includes a downwardly draping lower portion 135 for reasons disclosed hereinbelow. In addition, a plurality of tensioners 140*a*, 140*b* and 140*c* are provided for tensioning ribbon 90 for reasons well known in the art. Also, a picker mechanism, generally referred to as 150 is also provided for "picking" individual receiver sheets 30 from stack 40 and feeding receiver sheets 30 onto guide ramp 120. Picker mechanism 150 includes a picker roller 160 rotatable in a direction of a fourth arrow 165 by means of a motor (not shown). Picker roller 160 includes a pivot arm 170 pivotable about a pivot point 175 by means of an actuator 180. In this manner, pivot arm 170 and picker roller 160 connected thereto are capable of pivoting from a first position 185 to a second position 187 thereof. A display 190, which may be an LED (Light Emitting Diode) or an LCD (Liquid Crystal Display), displays status of printer 10, such as error codes indicating picker mechanism 150 is incapable of printing sheets 30 due, for example, to picker mechanism 150 attempting to pick a cardboard plaque at the bottom of stack 40 of receiver sheets. Moreover, an output receptacle 200 is positioned to receive sheet 30 when image 20 is completely printed thereon. Print head 50, support 60, supply spool 80, take-up spool 100, guide 120, guide roller 130, tensioners 140*a*/*b*/*c*, picker mechanism 150 and display 190 are preferably connected to a frame 210 for supporting these components within printer 10. These components, including frame 210, are enclosed within a printer enclosure 210 for protecting the components from damage, which enclosure 210 has an opening 215 for reasons disclosed hereinbelow.

Referring to FIGS. 1, 2, 3, 4, 5 and 6, the invention also comprises a receiver sheet supply tray 220 for holding the stack 40 of receiver sheets, which tray 220 is sized to be received into opening 215 and thus into enclosure 210. Tray 220 includes a front sidewall 230*a* and a rear sidewall 230*b* parallel to front sidewall 230*a*. Integrally formed with front sidewall 230*a* is a protruding abutment 240 for abutting lower portion 135 of guide ramp 120, so that forward travel of tray 220 is limited by presence of lower portion 135 when tray 220 is inserted into enclosure 210. Interposed between front sidewall 230*a* and rear sidewall 230*b* are a first lateral sidewall 230*c* and a second lateral sidewall 230*d*, the second lateral sidewall 230*d* being parallel to first lateral sidewall 230*c* and spaced-apart therefrom. Tray 220 also includes a floor 250 integrally attached to sidewalls 230*a*/*b*/*c*/*d*. Formed through second lateral sidewall 230*d* is a rectangularly-shaped first slot 260 for purposes disclosed hereinbelow. Tray 220 may further include a removable cover plate 270 extending from first lateral sidewall 230*c* to second lateral sidewall 230*d* and resting thereon for protecting stack 40 of sheets from fouling by external dirt, dust and the like while tray 220 is partially received into opening 215.

Referring to FIGS. 2, 3, 4, 5 and 6, disposed inwardly of sidewalls 230*a*/*b*/*c*/*d* is an alignment member 280 having an upright first panel 290*a* and an upright second panel 290*b* disposed parallel to first panel 290*a* and spaced apart therefrom by a predetermined distance. The purpose of panels 290*a*/*b* is to align lateral marginal edges of stack 40, so that picker roller 160 picks individual sheets 30 without "jamming". Second panel 290*b* has a rectangularly-shaped second slot 295 formed therethrough, which second slot 295 is generally aligned with first slot 260 for reasons disclosed hereinbelow. In addition, disposed inwardly of panels 290*a*/*b* is a movable platen 300 supported on floor 250 by at least one biasing member, such as a coiled spring 310 which upwardly biases platen 300 against stack 40. Platen 300 is shown in a depressed state but with sheets 30 removed for purposes of clarity. Spring 310 is preferably attached both to platen 300 and floor 250, so that platen remains connected to tray 220. Moreover, as spring 310 upwardly biases platen 300, stack 40 is pressed against a pair of colinearly aligned separation pawls 320*a* and 320*b* connected to front sidewall 230*a*. Pawls 320*a*/*b* assist in separating individual sheets 30 from stack 40 as sheets 30 feed from tray 220.

Referring now to FIGS. 4, 5, 6, 7, 8, 9 and 10, the invention includes an indicator 330 responsive to amount of sheets 30 disposed in tray 220. Indicator 330 comprises an indicator arm 340 integrally attached to platen 300 at an end portion thereof and laterally outwardly extending from platen 300. In this regard, arm 340 is slidably received through second slot 295, such that arm 340 is slidably vertically movable within second slot 295. Of course, arm 340 is movable with platen 300 and to a like extent. That is, arm 340 moves as height of stack 40 decreases because arm 340 is rigidly affixed to platen 300. The other end portion of arm 340 includes an upright flange portion 350 sized to be slidably vertically disposed in first slot 260. Of course, flange portion 350 is movable with arm 340 and to a like extent as arm 340 moves. This is so because flange portion 350 is rigidly affixed to arm 340. Flange portion 350 has a first surface area 360 thereon of a predetermined first light reflectance, which is associated with a "low height" of stack 40, as disclosed more fully hereinbelow. Flange portion 350 also has a second surface area 370 thereon disposed below first surface area 360. Second surface area 370 has a predetermined second light reflectance, which is associated with "no height" of stack 40, as disclosed more fully hereinbelow. If desired, the "predetermined second light reflectance" may be "black" such that no light is reflected.

Of course, when there is no height of stack 40, there are no sheets 30 in printer 10 and printer 10 has run-out of receiver sheets 30. In the preferred embodiment of the invention, first surface area 360 has high light reflectance and second surface area 370 has low or no light reflectance. Although only two surface areas 360/370 are disclosed herein, there may be additional surface areas for indicating amounts of sheets 30 present in tray 220 intermediate a "low amount" and "no amount" of sheets 30. A sensor 380 is preferably centrally aligned with first slot 260 and optically coupled with flange portion 350 while flange portion 350 resides in first slot 260. Flange portion 350 will reside in first slot 260 as arm 340 upwardly moves, which occurs as platen 300 upwardly moves. Platen 300 will upwardly move as stack 40 is depleted of sheets 30, which occurs as picker roller 160 picks individual sheets 30 from stack 40. In addition, sensor 380 is capable of casting light upon flange portion 350 and sensing light reflected therefrom. That is, sensor 380 emits light which falls upon either first surface area 350 or second surface area 360, as the case may be, when either first surface area 350 or second surface area 360 is caused to move into alignment with sensor 370. When first surface area 350 moves into alignment with sensor 370, a stack "low" condition is reached. Similarly, when second surface area 360 moves into alignment with sensor 370, a "no stack" (i.e., stack "empty") condition is reached. Sensor 380 preferably includes a light source for emitting light to be intercepted by flange portion 350 and a light-receiving diode for receiving light reflected from flange portion 350. Sensor 380 is relatively small in dimension in order to conveniently fit within enclosure 210. For example, sensor 380 may have dimensions of approximately 0.710 inches (i.e., 1.803 cms) long, 0.610 inches (i.e., 1.549 cms) wide and 0.25 inches (i.e., 0.635 cms) in vertical height. In this regard, sensor 380 may be a Model "OPTEK" sensor available from Optek Tecnology, Incorporated located in McKinney, Tex.

Referring to FIGS. 2, 4, 5, 6 7, 8, 9 and 10, a controller 390 may also be provided, if desired, which interconnects picker mechanism 150 and sensor 380 for interrupting operation of picker mechanism 150 when sensor 380 senses no height of stack 40, which occurs when there are no sheets 30 present in tray 220. In this regard, controller 390 will interrupt operation of picker mechanism 150 by causing actuator 180 to move picker roller 160 from first position 185 to second position 187 thereof. Controller 390 may also interconnect display 190 and sensor 380 for displaying height of stack 40, if desired. Controller 390 and wiring associated therewith are relatively small to fit within the existing space already found in the typical thermal printer 10. This is so because in the preferred embodiment of the present invention, controller 390 is relatively small resistor-sized device attachable to virtually any one of circuit boards already present in printer 10.

It is understood from the description hereinabove that an advantage of the present invention is that use thereof reduces risk of running-out of receiver sheets during a production run due to low receiver sheets being present in the tray at the start of the production run. This is so because sensor 380 senses when stack 40 is low in receiver sheets 30 by sensing highly reflective first surface area 360 and sending a signal to display 190 to inform an operator of printer 10 of the low number of sheets 30 present in tray 220.

It is also understood from the description hereinabove that another advantage of the present invention is that use thereof reduces likelihood of generation of a "printer malfunction" error code due to the picker attempting to pick the cardboard plaque at the bottom of the stack of receiver sheets. This is true because sensor 380 senses when there is no stack 40 by sensing low reflective first surface area 360 and sending a signal to display 190 specifically to inform the operator of printer 10 that there are "no sheets" 30 present in tray 220. This is also true because sensor 380 senses when there is no stack 40 by sensing low reflective first surface area 360 and sending a signal to picker mechanism 150 to interrupt operation of picker mechanism 150 by moving picker roller 160 from first position 185 to second position 187 thereof.

It is further understood from the description hereinabove that yet another advantage of the present invention is that addition of a bulky component to detect receiver stack height is avoided, which additional bulky component would otherwise increase footprint and/or height of the printer. This is so because, in the typical thermal printer, there is sufficient space to include relatively small sensor 380 and controller 390 and any additional wiring associated therewith.

The invention has been described in detail with particular reference to certain preferred embodiments thereof, but it will be understood that variations and modifications can be effected within the spirit and scope of the invention. For example, sensor 390 is disclosed herein as an optical sensor optically coupled to indicator 330. However, sensor 390 may be a magnetic sensor magnetically coupled to indicator 330. In this case indicator 330 has different surface areas 360/370 emanating different magnetic fields detectable by magnetic sensor 330. As another example, second reflective surface 370 is disclosed herein as positioned below first reflective surface 360. However, second reflective surface 370 may be positioned above first reflective surface 360, and the sensing capabilities of sensor 380 adjusted accordingly, if desired.

Moreover, as is evident from the foregoing description, certain other aspects of the invention are not limited to the particular details of the examples illustrated, and it is therefore contemplated that other modifications and applications will occur to those skilled in the art. It is accordingly intended that the claims shall cover all such modifications and applications as do not depart from the true spirit and scope of the invention.

Therefore, what is provided are a printer and receiver supply tray adapted to sense amount of receiver therein, and method thereof.

PARTS LIST:

| | |
|---|---|
| 10 | printer |
| 20 | image |
| 30 | receiver sheet |
| 40 | stack of receiver sheets |
| 50 | print head |
| 60 | support |
| 65 | first arrow |
| 70 | nip |
| 80 | donor supply spool |
| 85 | second arrow |
| 90 | dye donor ribbon |
| 100 | donor ribbon take-up spool |
| 110 | third arrow |
| 120 | guide ramp |
| 130 | guide roller |
| 135 | lower portion of guide ramp |
| 140a/b/c | tensioners |
| 150 | picker mechanism |
| 160 | picker roller |
| 165 | fourth arrow |
| 170 | pivot arm |
| 175 | pivot point |
| 180 | actuator |
| 185 | first position of picker roller |

-continued

| PARTS LIST: | |
|---|---|
| 187 | second position of picker roller |
| 190 | display |
| 200 | output receptacle |
| 210 | printer enclosure |
| 215 | printer enclosure opening |
| 220 | receiver tray |
| 230a | front sidewall |
| 230b | rear sidewall |
| 230c | first lateral sidewall |
| 230d | second lateral sidewall |
| 240 | abutment |
| 250 | floor |
| 260 | first slot |
| 270 | cover plate |
| 280 | alignment member |
| 290a | first panel |
| 290b | second panel |
| 300 | platen |
| 310 | spring |
| 320a/b | separation pawls |
| 330 | indicator |
| 340 | indicator arm |
| 350 | flange portion |
| 360 | first reflective surface area |
| 370 | second reflective surface area |
| 380 | sensor |
| 390 | controller |

What is claimed is:

1. A printer adapted to sense amount of receiver therein, comprising:

(a) a print head;

(b) a tray disposed relative to said print head for holding a plurality of cut sheets of the receiver; and (c) an indicator connected to said tray and responsive to amount of sheets in said tray, said indicator having a plurality of surface areas thereon each of a predetermined light reflectance associated with a corresponding amount of sheets in said tray.

2. The printer of claim 1, further comprising a sensor optically coupled to said indicator for sensing light reflected from the surface area thereof.

3. The printer of claim 2, further comprising:

(a) a sheet feeder associated with said print head and engageable with the sheets for sequentially feeding the sheets from said tray and to said print head; and (b) a controller interconnecting said sheet feeder and said sensor for interrupting operation of said sheet feeder as said sensor senses substantially no amount of sheets in said tray.

4. A printer adapted to sense amount of receiver therein, comprising:

(a) a print head for printing an image on the receiver;

(b) a supply tray disposed relative to said print head for holding a plurality of cut sheets of the receiver, the cut sheets defining a stack of sheets having a predetermined height;

(c) a sheet feeder associated with said tray and engageable with the stack of sheets for sequentially feeding the sheets from said tray and to said print head, so that height of the stack of sheets decreases as the sheets are fed therefrom;

(d) a platen movably connected to said tray for continuously supporting the stack of sheets therein as height of the stack of sheets decreases;

(e) an indicator connected to said platen and movable therewith for indicating height of the stack of sheets as the height of the stack of sheets decreases, so that said indicator is responsive to amount of sheets in said tray, said indicator having a plurality of surface areas thereon each of a predetermined light reflectance associated with a corresponding amount of sheets in said tray; and (f) a sensor optically coupled to said indicator for sensing light reflected from the surface area thereof, said sensor adapted to cast light on the surface area and sense the light reflected thereby.

5. The printer of claim 4, further comprising a controller interconnecting said sheet feeder and said sensor for interrupting operation of said sheet feeder as said sensor senses no height of sheets in said tray.

6. The printer of claim 4, further comprising a display associated with said sensor for displaying height of sheets in said tray.

7. For use in a printer, a tray adapted to sense amount of receiver therein, comprising:

(a) a support for supporting a stack of cut sheets of the receiver to be fed from said support, said support being movable in response to a decreasing height of the stack of sheets as the sheets feed from said support; and (b) an indicator connected to said support and movable therewith for indicating height of the stack of sheets as the height of the stack of sheets decreases, said indicator having a plurality of surface areas thereon each of predetermined light reflectance associated with a corresponding height of the stack of sheets.

8. The tray of claim 7, further comprising a sensor optically coupled to said indicator for sensing the light reflected from the surface area thereof.

9. For use in a printer, a tray adapted to sense amount of receiver therein, comprising:

(a) a housing having a sidewall having a slot therethrough;

(b) a platen movably connected to said housing for supporting a stack of cut sheets of the receiver to be sequentially fed from said platen, said platen being movable in response to a decreasing height of the stack of sheets as the sheets feed from said platen; and (c) an indicator connected to said platen and movable therewith for indicating height of the stack of sheets as the height of the stack of sheets decreases, said indicator having a flange portion thereof sized to be slidably disposed in the slot, the flange portion having a first surface area thereon of predetermined first light reflectance associated with a low height of stack of sheets supported on said platen as the flange portion is slidably disposed in the slot; and (d) a sensor optically coupled to said indicator for sensing light reflected from the first surface area of the flange portion.

10. The tray of claim 9, wherein the flange portion of said indicator has a second surface area thereon of predetermined second light reflectance associated with substantially no stack of sheets supported on said platen as the flange portion is slidably disposed in the slot.

11. For use in association with a printer, a method of sensing amount of receiver therein, comprising the steps of:

(a) providing a print head;

(b) disposing a tray relative to the print head for holding a plurality of cut sheets of the receiver; and (c) connecting an indicator to the tray, the indicator being responsive to amount of sheets in the tray and having a plurality of surface areas thereon each of a predetermined light reflectance associated with a corresponding amount of sheets in the tray.

12. The method of claim 11, further comprising the step of optically coupling a sensor to the indicator for sensing light reflected from the surface area thereof.

13. The method of claim 12, further comprising the steps of:

(a) providing a sheet feeder in association with the print head, the sheet feeder being engageable with the sheets for sequentially feeding the sheets from the tray and to the print head; and (b) connecting a controller to the sheet feeder and the sensor for interrupting operation of the sheet feeder when the sensor senses no amount of sheets in the tray.

14. For use in association with a printer, a method of sensing amount of receiver therein, comprising the steps of:

(a) providing a print head for printing an image on the receiver;

(b) disposing a supply tray relative to the print head for holding a plurality of cut sheets of the receiver, the cut sheets defining a stack of sheets having a predetermined height;

(c) providing a sheet feeder in association with the tray and engageable with the stack of sheets for sequentially feeding the sheets from the tray and to the print head, so that height of the stack of sheets decreases as the sheets are fed therefrom;

(d) connecting a movable platen to the tray for continuously supporting the stack of sheets therein as height of the stack of sheets decreases;

(e) connecting an indicator to the platen, the indicator being movable with the platen for indicating height of the stack of sheets as the height of the stack of sheets decreases, so that the indicator is responsive to amount of sheets in the tray, the indicator having a plurality of surface areas thereon each of a predetermined light reflectance associated with a corresponding amount of sheets in the tray; and (f) optically coupling a sensor to the indicator for sensing light reflected from the surface area thereof, the sensor adapted to cast light on the surface area and sense the light reflected thereby.

15. The method of claim 14, further comprising the step of connecting a controller to the sheet feeder and the sensor for interrupting operation of the sheet feeder as the sensor senses no height of sheets in the tray.

16. The method of claim 14, further comprising the step of providing a display in association with the sensor for displaying height of sheets in the tray.

17. For use in association with a printer, a method of assembling a tray adapted to sense amount of receiver therein, comprising the steps of:

(a) providing a support for supporting a stack of cut sheets of the receiver to be fed from the support, the support being movable in response to a decreasing height of the stack of sheets as the sheets feed from the support; and (b) connecting an indicator to the support, the indicator being movable with the support for indicating height of the stack of sheets as the height of the stack of sheets decreases, the indicator having a plurality of surface areas thereon of predetermined light reflectance associated with a corresponding height of the stack of sheets.

18. The method of claim 17, further comprising the step of optically coupling a sensor to the indicator for sensing light reflected from the surface area thereof.

19. For use in association with a printer, a method of assembling a tray adapted to sense amount of receiver therein, comprising the steps of:

(a) providing a housing having a sidewall having a slot therethrough;

(b) connecting a movable platen to the housing for supporting a stack of cut sheets of the receiver to be sequentially fed from the platen, the platen being movable in response to a decreasing height of the stack of sheets as the sheets feed from the platen;

(c) connecting an indicator to the platen, the indicator being movable with the platen for indicating height of the stack of sheets as the height of the stack of sheets decreases, the indicator having a flange portion thereof sized to be slidably disposed in the slot, the flange portion having a first surface area thereon of predetermined first light reflectance associated with a low height of stack of sheets supported on the platen; and (d) optically coupling a sensor to the indicator for sensing light reflected from the first surface area of the flange portion.

20. The method of claim 19, wherein the step of connecting an indicator having a flange portion comprises the step of connecting an indicator having a flange portion having a second surface area thereon of predetermined second light reflectance associated with substantially no stack of sheets supported on the platen.

* * * * *